US008794026B2

(12) United States Patent
Kuehl et al.

(10) Patent No.: US 8,794,026 B2
(45) Date of Patent: Aug. 5, 2014

(54) SECONDARY COOLING APPARATUS AND METHOD FOR A REFRIGERATOR

(75) Inventors: Steven John Kuehl, Stevensville, MI (US); Douglas D. Leclear, Benton Harbor, MI (US); Anderson Bortoletto, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1133 days.

(21) Appl. No.: 12/105,719

(22) Filed: Apr. 18, 2008

(65) Prior Publication Data

US 2009/0260371 A1 Oct. 22, 2009

(51) Int. Cl.
*F25D 17/02* (2006.01)

(52) U.S. Cl.
USPC ..... 62/434; 62/333

(58) Field of Classification Search
USPC ..... 62/434, 333, 99, 334, 442; 165/164
See application file for complete search history.

(56) References Cited

U.S. PATENT DOCUMENTS

| | | | | |
|---|---|---|---|---|
| 1,960,764 | A | | 5/1934 | Warner |
| 2,022,764 | A | | 12/1935 | Gibson et al. |
| 2,028,046 | A | | 1/1936 | Calatroni |
| 2,030,676 | A | | 2/1936 | Atchison |
| 2,133,948 | A | | 10/1938 | Buchanan |
| 2,133,949 | A | | 10/1938 | Buchanan |
| 2,133,962 | A | | 10/1938 | Shoemaker |
| 2,145,773 | A | | 1/1939 | Muffly |
| 2,167,036 | A | | 7/1939 | Baker |
| 2,199,413 | A | | 5/1940 | Patrignani |
| 2,245,053 | A | | 6/1941 | Sanders, Jr. |
| 2,262,635 | A | | 11/1941 | Coons |
| 2,401,460 | A | * | 6/1946 | Charland ..... 62/334 |
| 2,435,102 | A | | 1/1948 | Rundell |
| 2,440,534 | A | | 4/1948 | Atchison |
| 2,454,537 | A | | 11/1948 | Atchison |
| 2,458,560 | A | | 1/1949 | Buchanan |
| 2,462,240 | A | | 2/1949 | Van Vliet et al. |
| 2,471,137 | A | | 5/1949 | Atchison |
| 2,482,569 | A | | 9/1949 | Zearfoss, Jr. |
| 2,493,488 | A | | 1/1950 | Jordan et al. |
| 2,539,908 | A | | 1/1951 | Jenkins |
| 2,576,663 | A | | 11/1951 | Atchison |
| 2,580,220 | A | | 12/1951 | Cooper |

(Continued)

FOREIGN PATENT DOCUMENTS

| | | |
|---|---|---|
| EP | 1 930 671 B1 | 6/2008 |
| JP | 10047824 A | 2/1998 |

(Continued)

*Primary Examiner* — Cassey D Bauer

(57) ABSTRACT

The present invention provides a secondary cooling apparatus and method of providing cooling to one or more features in a refrigerator. In one exemplary aspect of the present invention, the refrigerator includes a cabinet having a door, a first cooling loop in the cabinet, and a second cooling loop cooled by the first cooling loop. The secondary cooling loop is adapted to cool the one or more features in the cabinet or on the door of the refrigerator. In another exemplary aspect of the present invention, a method for providing cooling in a refrigerator to one or more features in a compartment or on a door of the refrigerator includes providing a first cooling loop within a refrigerator, cooling a secondary cooling loop directly or indirectly with the first cooling loop, and transferring cooling from the secondary cooling loop to the one or more features in the compartment or on the door of the refrigerator.

13 Claims, 7 Drawing Sheets

(56) References Cited

U.S. PATENT DOCUMENTS

| | | | | |
|---|---|---|---|---|
| 2,604,761 | A | 7/1952 | Atchison | |
| 2,635,437 | A | 4/1953 | Ullstrand | |
| 2,640,327 | A | 6/1953 | Alsing | |
| 2,667,756 | A | 2/1954 | Atchison | |
| 2,677,242 | A | 5/1954 | Grimshaw | |
| 2,687,020 | A | 8/1954 | Staebler et al. | |
| 2,692,482 | A | 10/1954 | Shoemaker | |
| 2,697,331 | A | 12/1954 | Zearfoss, Jr. | |
| 2,706,894 | A | 4/1955 | Shoemaker | |
| 2,709,343 | A | 5/1955 | Muffly | |
| 2,728,199 | A | 12/1955 | Kurtz | |
| 2,728,203 | A | 12/1955 | King | |
| 2,733,574 | A | 2/1956 | Reber, Jr. | |
| 2,765,633 | A | 10/1956 | Muffly | |
| 2,777,297 | A | 1/1957 | Doeg | |
| 2,784,563 | A | 3/1957 | Baker | |
| 2,795,112 | A | 6/1957 | Muffly | |
| 2,900,803 | A | 8/1959 | Horton, Jr. | |
| 2,927,440 | A | 3/1960 | Kohl | |
| 3,025,679 | A | 3/1962 | Keighley | |
| 3,025,682 | A | 3/1962 | Kniffin | |
| 3,537,132 | A | 11/1970 | Alvarez | |
| 3,585,814 | A | 6/1971 | Van Cauwenberge | |
| 3,638,447 | A | 2/1972 | Abe | |
| 3,726,105 | A | 4/1973 | Auracher | |
| 3,766,745 | A | 10/1973 | Quick | |
| 3,786,648 | A | 1/1974 | Rice | |
| 3,788,089 | A | 1/1974 | Graves | |
| 3,866,429 | A | 2/1975 | Blomberg | |
| 4,003,214 | A | 1/1977 | Schumacher | |
| 4,192,149 | A | 3/1980 | Webb | |
| 4,270,364 | A | 6/1981 | Oonishi et al. | |
| 4,280,335 | A | 7/1981 | Perez et al. | |
| 4,328,681 | A | 5/1982 | Sakamoto et al. | |
| 4,338,794 | A | 7/1982 | Haasis, Jr. | |
| 4,439,998 | A | 4/1984 | Horvay et al. | |
| 4,476,690 | A | 10/1984 | Iannelli | |
| 4,512,162 | A | 4/1985 | Etou et al. | |
| 4,712,387 | A | 12/1987 | James et al. | |
| 4,756,164 | A | 7/1988 | James et al. | |
| 4,845,955 | A | 7/1989 | Taylor | |
| 4,898,002 | A | 2/1990 | Taylor | |
| 4,918,936 | A | 4/1990 | Sakamoto | |
| 4,918,942 | A | 4/1990 | Jaster | |
| 4,979,371 | A | 12/1990 | Larson | |
| 5,088,300 | A | 2/1992 | Wessa | |
| 5,103,650 | A | 4/1992 | Jaster | |
| 5,191,776 | A | 3/1993 | Severance et al. | |
| 5,218,830 | A | 6/1993 | Martineau | |
| 5,235,820 | A | 8/1993 | Radermacher et al. | |
| 5,272,884 | A | 12/1993 | Cur et al. | |
| 5,375,432 | A | 12/1994 | Cur | |
| 5,396,777 | A | 3/1995 | Martin | |
| 5,406,805 | A | 4/1995 | Radermacher et al. | |
| 5,465,591 | A | 11/1995 | Cur et al. | |
| 5,715,693 | A | 2/1998 | van der Walt et al. | |
| 5,765,391 | A | 6/1998 | Lee et al. | |
| 5,832,738 | A | 11/1998 | Shin | |
| 5,884,501 | A | 3/1999 | Goldstein | |
| 6,038,874 | A | 3/2000 | van der Walt et al. | |
| 6,056,046 | A | 5/2000 | Goldstein | |
| 6,185,948 | B1 | 2/2001 | Niki et al. | |
| 6,266,968 | B1 | 7/2001 | Redlich | |
| 6,286,332 | B1 | 9/2001 | Goldstein | |
| 6,370,895 | B1 | 4/2002 | Sakuma et al. | |
| 6,370,908 | B1 | 4/2002 | James | |
| 6,460,357 | B1 | 10/2002 | Doi et al. | |
| 6,490,877 | B2 | 12/2002 | Bash et al. | |
| 6,588,219 | B2 | 7/2003 | Zevlakis | |
| 6,598,410 | B2 | 7/2003 | Temmyo et al. | |
| 6,655,170 | B2 * | 12/2003 | Holz et al. | 62/440 |
| 6,658,879 | B2 | 12/2003 | Park et al. | |
| 6,679,073 | B1 | 1/2004 | Hu | |
| 6,694,762 | B1 | 2/2004 | Osborne | |
| 6,715,305 | B2 | 4/2004 | Doi et al. | |
| 6,729,150 | B2 | 5/2004 | Shin et al. | |
| 6,735,959 | B1 | 5/2004 | Najewicz | |
| 6,766,652 | B2 | 7/2004 | Kelly et al. | |
| 6,775,998 | B2 | 8/2004 | Yuasa et al. | |
| 6,883,603 | B2 | 4/2005 | Park et al. | |
| 6,895,767 | B2 | 5/2005 | Hu | |
| 6,898,947 | B2 | 5/2005 | Hebert | |
| 6,915,652 | B2 | 7/2005 | Lane et al. | |
| 6,935,127 | B2 | 8/2005 | Jeong et al. | |
| 6,952,930 | B1 | 10/2005 | Rafalovich et al. | |
| 6,964,177 | B2 | 11/2005 | Lee et al. | |
| 7,003,967 | B2 | 2/2006 | Rafalovich et al. | |
| 7,024,881 | B2 | 4/2006 | Jung | |
| 7,062,936 | B2 | 6/2006 | Rand et al. | |
| 7,065,982 | B2 | 6/2006 | Schmid et al. | |
| 7,104,083 | B2 | 9/2006 | Dube | |
| 7,126,499 | B2 | 10/2006 | Lin et al. | |
| 7,137,266 | B2 | 11/2006 | Kim et al. | |
| 7,181,921 | B2 | 2/2007 | Nuiding | |
| 7,185,507 | B2 | 3/2007 | Maglinger et al. | |
| 7,216,490 | B2 | 5/2007 | Joshi | |
| 7,281,386 | B2 | 10/2007 | McDougal et al. | |
| 2002/0033024 | A1 | 3/2002 | Hebert | |
| 2002/0069654 | A1 | 6/2002 | Doi et al. | |
| 2002/0092318 | A1 | 7/2002 | Tipton et al. | |
| 2002/0134095 | A1 | 9/2002 | Temmyo et al. | |
| 2003/0000241 | A1 | 1/2003 | Holz et al. | |
| 2003/0120236 | A1 | 6/2003 | Graef et al. | |
| 2003/0131618 | A1 | 7/2003 | Doi et al. | |
| 2004/0003613 | A1 | 1/2004 | Shin et al. | |
| 2004/0050083 | A1 | 3/2004 | Yuasa et al. | |
| 2004/0083746 | A1 | 5/2004 | Kim et al. | |
| 2004/0107727 | A1 | 6/2004 | Kim et al. | |
| 2004/0118139 | A1 | 6/2004 | Kelly et al. | |
| 2004/0123624 | A1 | 7/2004 | Ohta et al. | |
| 2004/0177626 | A1 | 9/2004 | Hu | |
| 2004/0226308 | A1 | 11/2004 | Dube | |
| 2005/0000238 | A1 | 1/2005 | Schmid et al. | |
| 2005/0011222 | A1 | 1/2005 | Hallin | |
| 2005/0028544 | A1 | 2/2005 | Dube | |
| 2005/0061009 | A1 | 3/2005 | Flinner et al. | |
| 2005/0081548 | A1 | 4/2005 | Lee et al. | |
| 2005/0086965 | A1 | 4/2005 | Lalumiere et al. | |
| 2005/0109056 | A1 | 5/2005 | Rand et al. | |
| 2005/0172665 | A1 | 8/2005 | Kim et al. | |
| 2005/0178150 | A1 | 8/2005 | Oshitani et al. | |
| 2005/0268644 | A1 | 12/2005 | Oshitani et al. | |
| 2006/0016202 | A1 | 1/2006 | Lyvers et al. | |
| 2006/0042310 | A1 | 3/2006 | Son | |
| 2006/0048529 | A1 | 3/2006 | Shin et al. | |
| 2006/0086128 | A1 | 4/2006 | Maglinger et al. | |
| 2006/0086132 | A1 | 4/2006 | Maglinger et al. | |
| 2006/0090496 | A1 | 5/2006 | Adamski et al. | |
| 2006/0130518 | A1 | 6/2006 | Kang et al. | |
| 2006/0137388 | A1 | 6/2006 | Kakehashi et al. | |
| 2006/0150670 | A1 | 7/2006 | Kato et al. | |
| 2006/0179858 | A1 | 8/2006 | Yoshioka et al. | |
| 2006/0179869 | A1 | 8/2006 | Lee et al. | |
| 2006/0187639 | A1 * | 8/2006 | Carswell | 361/699 |
| 2006/0201171 | A1 | 9/2006 | Unger et al. | |
| 2006/0207285 | A1 | 9/2006 | Oshitani et al. | |
| 2006/0225457 | A1 | 10/2006 | Hallin | |
| 2006/0260350 | A1 | 11/2006 | Van Meter et al. | |
| 2006/0277936 | A1 | 12/2006 | Norden et al. | |
| 2007/0033962 | A1 | 2/2007 | Kang et al. | |
| 2007/0068193 | A1 | 3/2007 | Yoon et al. | |
| 2007/0119193 | A1 | 5/2007 | Davis et al. | |
| 2008/0141699 | A1 * | 6/2008 | Rafalovich et al. | 62/340 |
| 2008/0216509 | A1 | 9/2008 | Kim et al. | |
| 2009/0158768 | A1 * | 6/2009 | Rafalovich et al. | 62/434 |

FOREIGN PATENT DOCUMENTS

| | | | |
|---|---|---|---|
| JP | 2006317077 | A | 11/2006 |
| JP | 2006317079 | A | 11/2006 |
| JP | 2009036416 | A | 2/2009 |
| WO | WO 02/086399 | A1 | 10/2002 |
| WO | WO 2007/084824 | A3 | 7/2007 |
| WO | WO 2008/082214 | A1 | 7/2008 |

(56) References Cited

FOREIGN PATENT DOCUMENTS

| | | | |
|---|---|---|---|
| WO | WO 2008/082217 | A1 | 7/2008 |
| WO | WO 2008/096245 | A2 | 8/2008 |
| WO | WO 2009/017282 | A1 | 2/2009 |
| WO | WO 2009/078562 | A1 | 6/2009 |

* cited by examiner

SECONDARY COOLING APPARATUS AND METHOD FOR A REFRIGERATOR

FIELD OF THE INVENTION

The present invention relates to the field of refrigeration. More specifically, the present invention provides a secondary cooling apparatus and method for cooling a refrigerator.

BACKGROUND OF THE INVENTION

Throughout the years, new features in refrigerators demand cooling, such as ice makers and water chillers have been incorporated into household refrigerators. As these features have evolved in terms of location, size, capacity and efficiency, new ways of providing refrigeration must be developed. Recently, much effort has been spent on cooling these features with cold air stream-based solutions. However, cold air stream-based solutions typically do not provide enough cooling capacity to refrigerator features, whether within the refrigerator or on the door, thus limiting their capacity and performance. Therefore, a need has been identified in the art to provide a secondary cooling loop for cooling features such as ice maker, water chiller, and/or other compartment within the refrigerator on the door.

There also have been considerable efforts recently to maximize the storage space in the fresh food and freezer compartments of a refrigerator. Some of these efforts focus on changing the size and position of the ice maker, either located in the freezer or fresh food compartment, but have limited ice production rates. Therefore, a need has been identified in the art to provide the consumer with the option of adding/removing different size and capacity module ice makers or other features, such as a water chiller, chilled compartment, or the like.

The present invention addresses these needs and other needs in the art to provide secondary cooling within the refrigerator or on the door of the refrigerator.

BRIEF SUMMARY OF THE INVENTION

The present invention relates to a secondary cooling apparatus and method for providing cooling to one or more features in a refrigerator. In one aspect of the present invention, a refrigerator having one or more evaporator systems adapted to provide cooling to one or more features of the refrigerator is disclosed. The refrigerator includes a cabinet having a door, a first cooling loop in the cabinet, and a secondary cooling loop cooled by the first cooling loop. The secondary cooling loop is adapted to cool one or more of the features in the cabinet or on the door of the refrigerator. In a preferred form, the refrigerator also includes a fluid reservoir cooled within a freezer or evaporator compartment, wherein the cooled fluid from the fluid reservoir is transferred to a heat exchanger associated with an ice maker, a thermosyphon or heat pipe transfers cooling from a freezer or evaporator compartment to a heat exchanger associated with an ice maker, a cooling line of the first or secondary cooling loop passes through an interface attaching the door to the cabinet to provide cooling to an ice maker and/or water chiller on the door, and a first coupler is adapted to mate with a secondary coupler of the secondary cooling loop, whereby cold liquid in the first cooling loop cools the first coupler to conductively cool the secondary coupler and liquid passing therethrough.

In another aspect of the present invention, a refrigerator having at least two evaporator systems adapted to provide cooling to one or more features of the refrigerator is disclosed. The refrigerator includes a cabinet having a door, a first cooling loop having a freezer compartment evaporator and a refrigerator compartment evaporator in fluid communication with the freezer compartment evaporator, and a secondary cooling loop cooled directly or indirectly by the first cooling loop to provide cooling to the one or more features in the cabinet or on the door of the refrigerator. In a preferred form, the refrigerator includes the secondary cooling loop in fluid connection with the first cooling loop before or after the refrigerator compartment evaporator to provide cooling to an evaporator on the door to cool an ice maker, heat exchanger, water chiller, and/or other compartment. The refrigerator compartment evaporator is conductively coupled with an ice maker, whereby the ice maker forms a coupled or direct extension of the refrigerator compartment evaporator.

In yet another aspect of the present invention, a refrigerator having one or more evaporator systems adapted to provide cooling to one or more features of the refrigerator is disclosed. The refrigerator includes a cabinet having a door, a first cooling loop with the one or more evaporator systems, and a heat exchanger of one of the evaporator systems being coupled with one of the features. The features are adapted to form a coupled or direct extension of the heat exchanger. In a preferred form, the heat exchanger includes a refrigerator compartment heat exchanger permanently coupled with an ice maker heat exchanger. This feature is adapted to couple to and de-couple from the heat exchanger to provide modularity of an ice maker or other component.

A new method for providing cooling in a refrigerator to one or more features in a compartment or on a door of the refrigerator is disclosed. The method includes providing a first cooling loop within the refrigerator, cooling a secondary cooling loop directly or indirectly with the first cooling loop, and transferring cooling from the secondary cooling loop to the features in the compartment or on the door of the refrigerator. In a preferred form, the method includes cooling fluid in a fluid reservoir within a freezer or evaporator compartment of the refrigerator to provide cooling to an ice maker, heat exchanger, water chiller, and/or compartment within the refrigerator or on the door, routing the first or secondary cooling loop through a hinge connecting the door to the refrigerator to provide cooling to one or more features on the door, and transferring cooling in the first cooling loop to the secondary cooling loop through a coupler by conduction.

Another method of the present invention for providing cooling in a refrigerator to one or more features in a compartment or on the door of the refrigerator is disclosed. The method includes providing a first cooling loop having a freezer compartment evaporator in fluid communication with a refrigerator compartment evaporator, cooling a secondary cooling loop directly or indirectly using the first cooling loop, and transferring cooling in the secondary cooling loop to the feature in the compartment or on the door. In a preferred form, the method includes connecting the secondary cooling loop to the first cooling loop after or before the refrigerator compartment evaporator to provide cooling to an evaporator on the door to cool an ice maker, heat exchanger, water chiller, and/or other compartment, conductively coupling the refrigerator compartment evaporator with an ice maker, whereby the ice maker forms a coupled or direct extension of the refrigerator compartment evaporator, and coupling together a first coupler in-line with the first cooling loop with a second coupler in-line with the secondary cooling loop to provide cooling from the first cooling loop to the secondary cooling loop, and substituting out one modular feature with another modular feature by de-coupling the one modular feature and re-coupling the other modular feature to the first coupler.

Further areas of applicability of the present invention will become apparent from the description provided herein. It should be understood that the description and specific examples are intended for the purposes of illustration only and are not intended to limit the scope of the present invention.

BRIEF DESCRIPTION OF THE DRAWINGS

The drawings described herein are for illustration purposes only and are not intended to limit the scope of the present invention in any way.

DETAILED DESCRIPTION OF THE EXEMPLARY EMBODIMENTS

The following description is merely exemplary in nature and is not intended to limit the present invention, application, or uses. The present invention provides a refrigerator 10 having one or more cooling loops and adapted for modularity of one or more features, including but not limited to, an ice maker, a water chiller, heat exchanger, and/or other compartment or feature.

Figure 1:
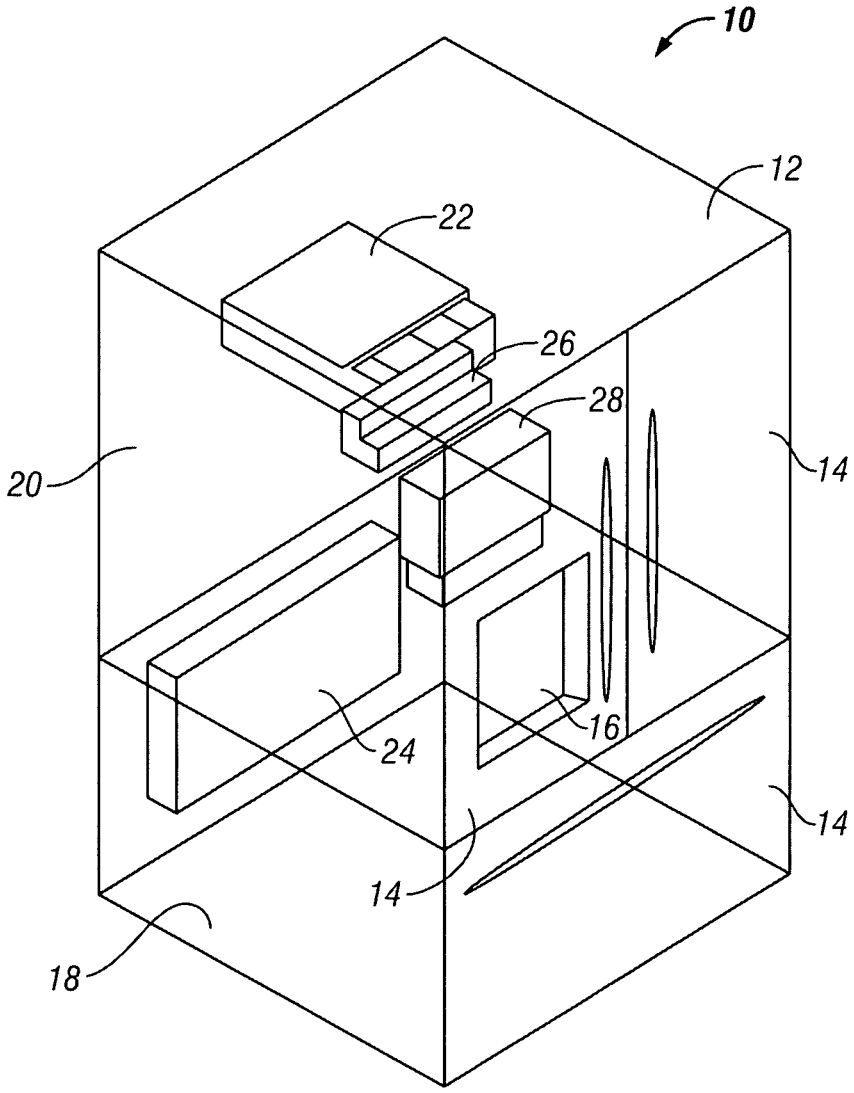
FIG. 1 is an isometric view of a refrigerator having an ice maker coupled to an evaporator according to an exemplary embodiment of the present invention.

FIG. 1 illustrates an exemplary embodiment of the refrigerator 10 of the present invention. Generally speaking, the refrigerator 10 includes a body or cabinet 12 enclosed by one or more doors 14. A dispenser 16 may be included on one or more of the doors 14. The dispenser 16 may be adapted to dispense ice and/or water on the door 14. The refrigerator 10 may also include a refrigerator compartment 20 and a freezer compartment 18. To provide cooling in the refrigerator compartment 20 or one or more other compartments in refrigerator 10, an evaporator 22 is provided in the refrigerator compartment 20. Likewise, evaporator 24 is provided in the freezer compartment 20 to provide cooling to the freezer compartment 18 or another compartment within the refrigerator 10. In one exemplary aspect of the present invention, the evaporator 22 in the freezer compartment 18 may be coupled directly or indirectly with one feature of the refrigerator 10, such as an ice maker 26. An ice bin 28 is provided for collecting and storing ice from the ice maker 26. Although an ice maker 26 is shown conductively coupled with the evaporator 22, the present invention contemplates many other features coupled with evaporator 22 in the refrigerator compartment 20. For example, a water chiller, additional heat exchanger or other fluid reservoir or compartment may be conductively coupled with the evaporator 22.

Figure 2:
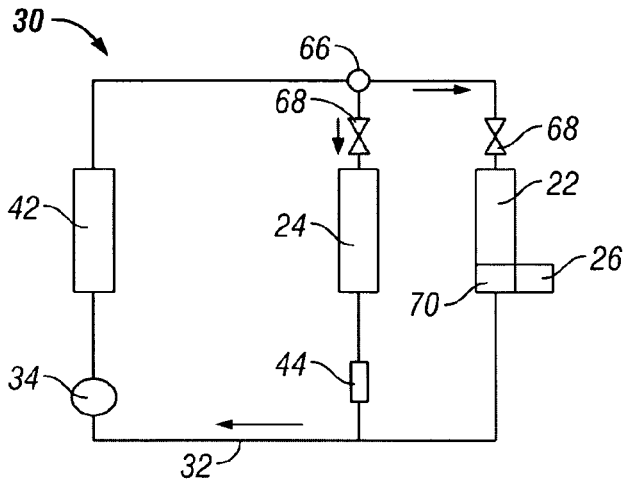
FIG. 2 is a refrigeration schematic for FIG. 1.

FIG. 2 shows a first cooling loop 30 of the refrigerator 10 shown in FIG. 1. The first cooling loop 30 includes a liquid circuit 32. The liquid circuit includes a compressor 34 and a condenser 42. Cooling liquid from the condenser 42 flows through valve 66. Valve 66 in the preferred form, is a three-way valve adapted to control the flow of cooling liquid through the evaporator 22, 24. Cooling liquid passing through valve 66 may pass through evaporator 22, 24 and through valve 68. In the preferred form, valve 68 is a capillary tube. Cooling liquid from valve 68 passes through evaporator 24 in the freezer compartment 18. Another valve 44 may be used to control the flow of cooling liquid from evaporator 24 back to compressor 34. In the preferred form, valve 44 is a one-way valve permitting flow in one direction from evaporator 24 to compressor 34. Cooling liquid passing through valve 68 and evaporator 22 in refrigerator compartment 20 may also pass through evaporator 70 of ice maker 26. The cooling liquid ultimately passes through the liquid circuit 32 back to the compressor 34.

Figure 3:
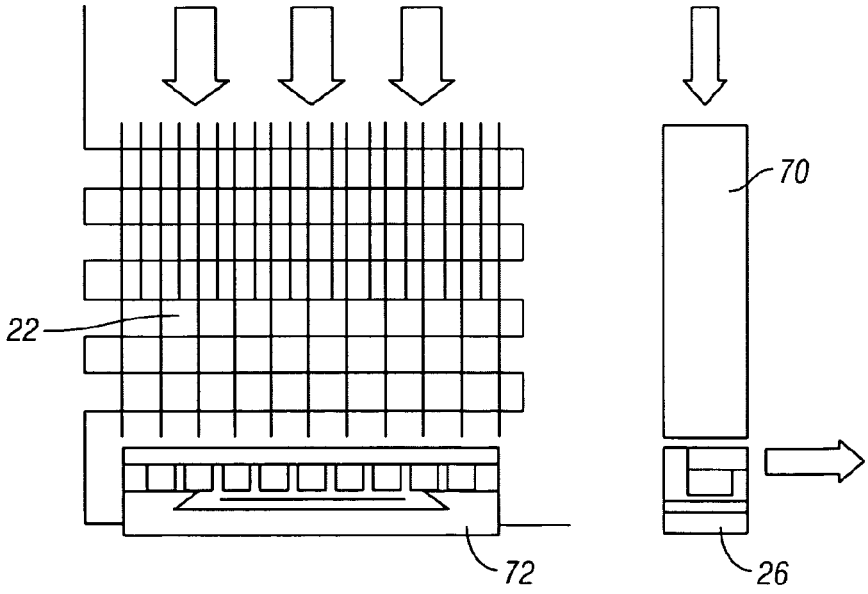
FIG. 3 is another schematic for the coupled ice maker and evaporator shown in FIG. 2.

The present invention contemplates numerous ways to couple the ice maker 26 with evaporator 22. For example, if evaporator 22 is placed in refrigerator compartment 20, evaporator 22 may have a surplus of cooling capacity which may be used for cooling ice maker 26. In one aspect, ice maker 26, as shown in FIG. 3, may be cooled as an extended surface of evaporator 22, whereby the ice maker 26 is a factory-set extension of evaporator 22 in refrigerator compartment 20. Cooling the ice maker 26 as an extended surface of evaporator 22 in refrigerator compartment 20 would open up opportunities for downsizing the heat exchanger in the refrigerator compartment 20. The present invention also contemplates that the coupling between the ice maker 26 and evaporator 22 in the refrigerator compartment 20 could be a permanent or temporary coupling. For example, coupler 72 could be permanently coupled with ice maker 26 such that ice maker 26 forms an extended surface of evaporator 22 in refrigerator compartment 20. Alternatively, coupling 72 may be adapted to allow ice maker 26 to couple and de-couple from evaporator 22. Allowing the ice maker 26 to couple and de-couple from coupler 72 of evaporator 22 provides the option of adding/removing different size and capacity modular ice makers. Coupler 72 would also allow different types of modular ice makers to be used such as clear ice or specially-shaped ice makers. Furthermore, coupling the ice maker 26 to evaporator 22 in refrigerator compartment 20 allows the ice maker 26 to be removed totally to provide additional storage space within the refrigerator compartment 20 or other compartment of the refrigerator 10. If the ice maker 26 is coupled to evaporator 22 and forms an extension of the evaporator 22 or the heat exchanger, the total volume occupied by evaporator 22 and ice maker 26 may be reduced considerably over conventional methods. Thus, the overall cost of the refrigerator 10 could be reduced. As well, consumers could be given the option of the add-on feature of an ice maker 26 of different size, capacity, and type.

Figure 4:
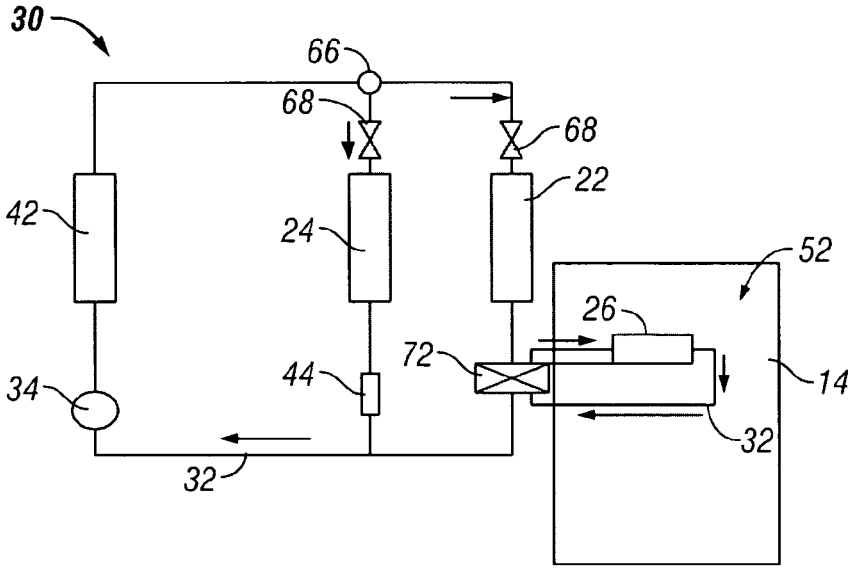
FIG. 4 is a refrigeration schematic having a secondary cooling loop according to an exemplary embodiment of the present invention.
Figure 5:
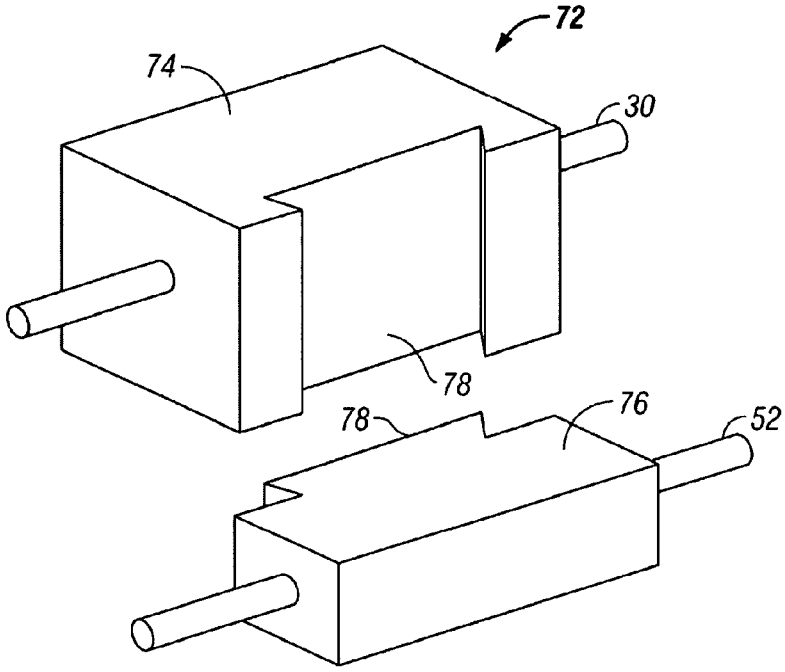
FIG. 5 is an illustration of the coupler shown in FIG. 4.
Figure 6:
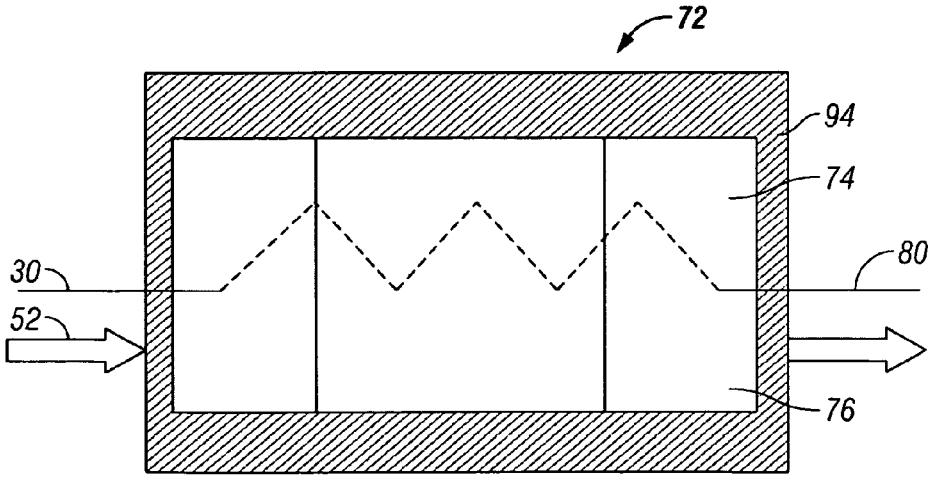
FIG. 6 is a sectional view of the coupler shown in FIG. 5.

FIG. 4 discloses another aspect of coupling one or more features such as an ice maker to a dual evaporator system to provide modularity of features such as an ice maker. FIG. 4 illustrates a refrigeration schematic having a first cooling loop 30 as described for FIG. 2. Coupled to the first cooling loop 30 is a secondary cooling loop 52. The secondary cooling loop 52 may be a separate cooling loop from the first cooling loop 30 whereby cooling capacity from the first cooling loop 30 is transferred conductively through coupler 72 whereby supply and return lines provide cooling capacity to ice maker 26 from coupler 72 cooled by the first coupling loop 30. The secondary cooling loop 52 is coupled to the first cooling loop 30 by way of coupler 72 as shown in FIGS. 5 and 6. Coupler 72 may be adapted to transfer cooling from liquid circuit 32 directly or indirectly. Coupler 72 allows cooling from the first cooling loop 30 to be transferred conductively to cooling liquid in the secondary cooling loop 52 to operate the ice maker or other feature on the door 14, such as a water chiller, chilled compartment, heat exchanger, or the like. FIG. 5 shows one exemplary coupler 72 of the present invention adapted to transfer cooling from the first cooling loop 30 to the secondary cooling loop 52. In one aspect of the coupler 72, cooling liquid travels through refrigerant line 80 in coupler 74. Coupler 74 is preferably designed to have a coupling interface 78 which maximizes the surface area for transferring heat. Moreover, coupler 74 may be adapted to have a coupling interface 78 for receiving a coupling interface 78 of coupler 76, where the secondary cooling loop 52 passes through coupler 76. The two interfaces 78 of coupler 74, 76 are adapted to mate together to provide maximum surface contact for transferring heat. The secondary cooling loop 52 may further include partially-insulated tubing (not shown) through which a refrigerant, such as glycol-based solutions, flows when driven by natural or forced convection. Because the ice maker 26 is part of the secondary cooling loop 52, the position of the ice maker 26 is not necessarily dependent on the position of the refrigeration compartment evaporator 22 as the liquid circuit 32 of the secondary cooling loop 52 transports heat from the ice maker 26 back to the first cooling loop 30 through coupler 72. As shown in FIGS. 5 and 6, the secondary cooling loop 52 may, in one embodiment, be coupled to the first cooling loop 30 by sliding the coupling interface 78 of the coupler 74, 76 together. By coupling the secondary cooling loop 52 to the first cooling loop 30, heat from the ice maker 26 may be dissipated through the evaporator outlet in the refrigerator compartment 20, thereby making possible the cooling capacity distribution from the first cooling loop 30 to the secondary cooling loop 52. Coupler may also include a housing 94 having insulative properties to help decrease heat transfer loss. As previously discussed, coupler 72 operates under the principal of conduction; therefore, the present invention seeks to maximize the coupling interface 78. Additionally, the present invention contemplates using high thermal conductivity materials such as aluminum or copper for the coupler 72. By coupling the secondary cooling loop to the first cooling loop 30, better use of the cooling capacity and the first cooling loop 30 is attained when using the refrigerator compartment evaporator 22 or when refrigerator 10 is in a cooling mode for cooling refrigerator compartment 20. For example, with an on/off compressor, the surplus of cooling capacity from the first cooling loop 30 when the refrigerator 10 is cooling the refrigerator compartment 20 could be used for providing cooling to ice maker 26 or other features within the refrigerator 10 or on the door 14. In another aspect of the present invention, coupler 72 provides modularity of one or more components, such as an ice maker, to provide the customer with the option of choosing several concepts of ice makers, such as a crescent ice mold, plastic mold, or clear ice module. As is standard with most ice makers, ice maker 26 may include an electric heater for detaching ice from the ice maker 26. Therefore, in one aspect of the present invention, cooling liquid from the secondary cooling loop 52 may be interrupted to prevent excessive amount of heat from being taken back to the first cooling loop 30 during the ice harvesting process. For example, the secondary cooling loop 52 may be de-coupled from the first cooling loop 30 by valves or other means, to prevent cooling liquid from flowing through ice maker 26 when driven by natural conduction means. Alternatively, cooling liquid in the secondary cooling loop 52 driven by forced convection, such as a pump, could be turned off during the ice harvesting process. The idea of coupling provides many benefits. Coupling the secondary cooling loop 52 to the first cooling loop 30 by way of coupler 76 allows modularity of one or more of the features, such as an ice maker 26 having different capacities and types of ice making abilities. Additionally, the present aspect helps to free up space in the refrigerator 10 or other compartment by easy removal of the ice maker 26. The present aspect also provides for efficient energy use of a dual evaporator system as shown in FIG. 4.

Figure 7:
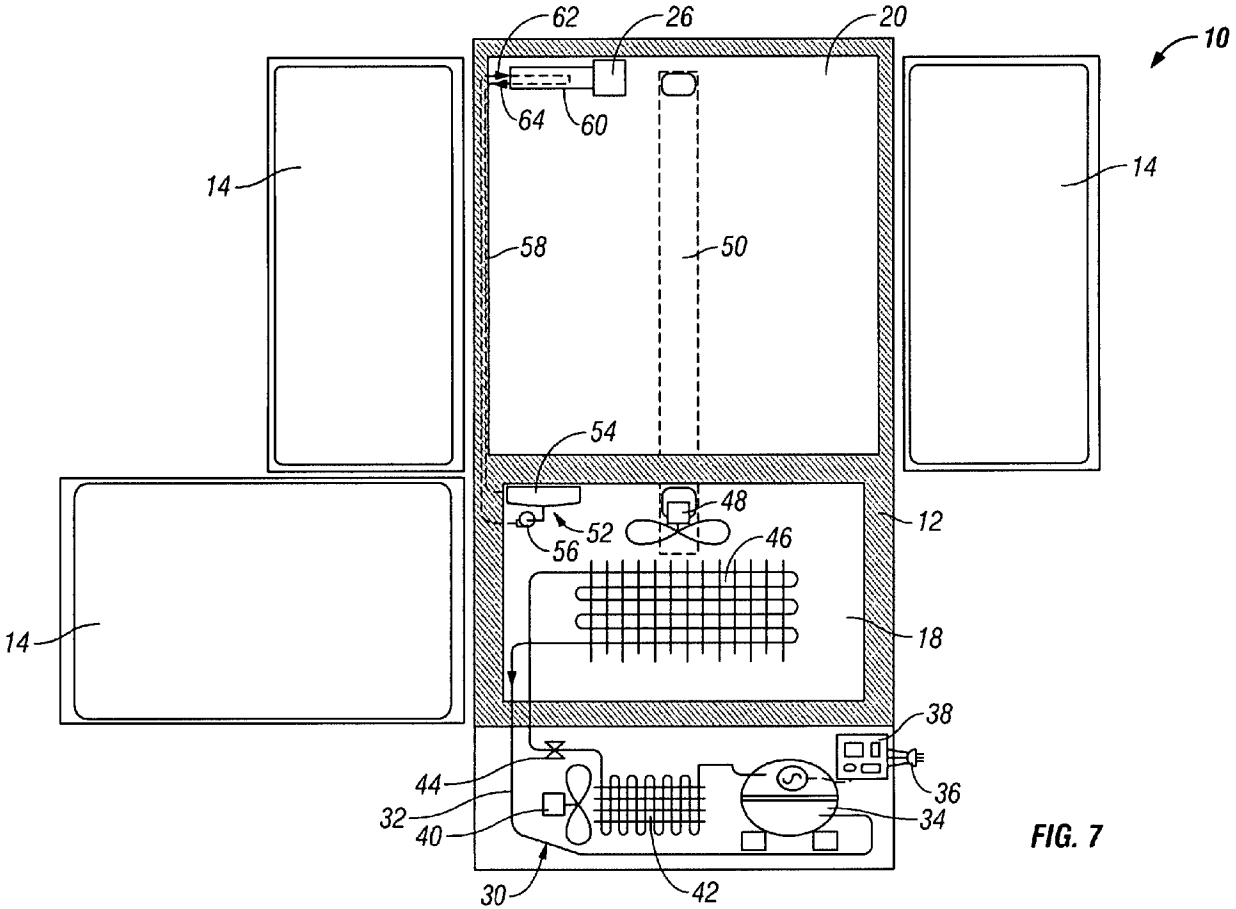
FIG. 7 is a front elevation view of a refrigerator having a secondary cooling loop according to an exemplary embodiment of the present invention.

FIG. 7 discloses another aspect of the present invention. FIG. 7 provides an illustration of one example of a solution to account for problems resulting from transfer/forced movement of chilled air or cold air streams to provide cooling to features, such as an ice maker of the refrigerator. FIG. 7 illustrates a refrigerator 10 having a body or cabinet 12 with one or more doors 14 mounted thereto. The refrigerator 10 includes a freezer compartment 18 and a refrigerator compartment 20. A first cooling loop 30 is positioned within the body or cabinet 12 of the refrigerator 10. The first cooling loop 30 has a power connector 36 electrically connected to an electrical panel 38 for providing power to a compressor 34. Cooling liquid or refrigerant from the compressor 34 passes through condenser 42 cooled by fan 40. Expansion device 44 controls the flow of cooling liquid from condenser 42 into evaporator 46 located in freezer compartment 18. Cooling liquid passes from the evaporator 46 through liquid circuit 32 back to compressor 34. Refrigerator 10 may include fan 48 adapted to move chilled air from freezer compartment 18 through duct 50 into refrigerator compartment 20. A secondary cooling loop 52 is illustrated in the freezer and refrigerator compartment 18, 20 of the refrigerator 10. The secondary cooling loop 52 includes a liquid circuit 58 adapted to convey cooling liquid, such as water-alcohol or water-brine solution, from reservoir 54 through liquid circuit 58 to heat exchanger 60. Cooling liquid within the liquid circuit 58 enters the heat exchanger 60 through supply line 62 and returns to the reservoir 54 through return line 64 by way of pump 56 adapted to recirculate cooling liquid within the liquid circuit 58. Liquid within the reservoir 54 and freezer compartment 18 is chilled by the cooling capacity of the evaporator 46. The chilled liquid in reservoir 54 is communicated through heat exchanger 60 of ice maker 26 to provide sufficient cooling capacity to ice maker 26 for making ice within the refrigerator compartment 20. Although FIG. 7 illustrates the ice maker 26 being positioned in refrigerator compartment 20, the present invention also contemplates locating the ice maker 26 of the secondary cooling loop 52 within the freezer compartment 18, on one or more of doors 14 and/or other compartments associated with refrigerator 10. Furthermore, secondary cooling loop 52 could be used to provide cooling capacity to other features, such as a water chiller, heat exchanger, chilled compartment within the refrigerator 10 or on door 14, or the like. The present invention also contemplates other possible concepts for cooling or providing cooling capacity to one or more features, such as an ice maker 26 using secondary cooling loop 52. For example, secondary cooling loop 52 could operate as a thermosyphon or heat pipe for transferring cooling capacity from the freezer compartment 18 or other compartment, such as an evaporator compartment, to one or more features of the refrigerator 10, such as heat exchanger 60 of ice maker 26.

Figure 8:
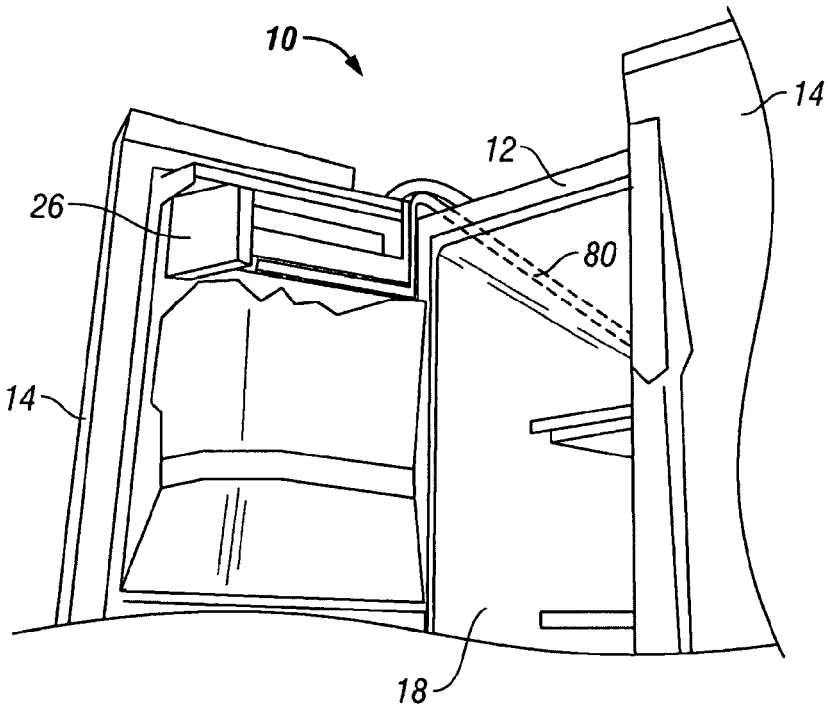
FIG. 8 is a perspective view of a refrigerant line extending from the cabinet of the refrigerator to the door through a hinge according to an exemplary embodiment of the present invention.

FIGS. 8-11 disclose another aspect of the present invention. FIGS. 8-11 disclose an exemplary aspect of the present invention providing cooling capacity to one or more features on a door 14 of the refrigerator 10. FIG. 8 illustrates a partial perspective view of refrigerator 10 having a body or cabinet 12 with a pair of doors 14 attached thereto. Door 14 of refrigerator 10 articulates with respect to cabinet 12 by way of hinge 82 shown in FIG. 9. Ice maker 26 is shown on door 14 of refrigerator 10. A cooling line 80 is shown passing from the cabinet 12 of the refrigerator 10 to ice maker 26 on door 14 through hinge 82, as best illustrated in FIG. 8. Although FIG. 8 illustrates an ice maker 26 on the door 14 of the refrigerator 10, the present invention contemplates assisting other door-placed features with cooling capacity from the refrigerator 10, such as a water chiller, heat exchanger, chilled compartment, or the like.

Figure 9:
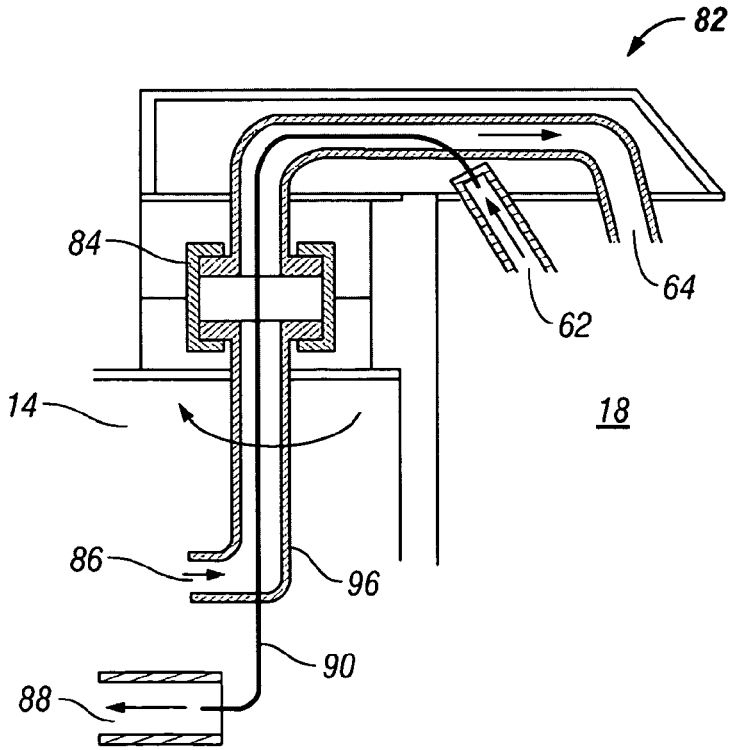
FIG. 9 is a sectional view of the hinge shown in FIG. 8 according to an exemplary embodiment of the present invention.

FIG. 9 best illustrates how cooling lines may be positioned through hinge 82 to provide cooling capacity from the refrigerator 10 to one or more features, such as in ice maker 26, on the door 14 of the refrigerator 10. To pass supply line 62 and return line 64 through joint 84 of hinge 82, supply line 62 and return line 64 are placed concentrically through joint 84 and hinge 82. Return line 64 and/or supply line 62 may be a capillary tube 90 or suction line 96 in the case of passing cooling liquid through the hinge 82 from the first cooling loop. Thus, cooling capacity from a first cooling loop 30 within refrigerator 10 is transferred through supply line 62 and/or capillary tube 90 to inlet 88 feeding cooling liquid to one or more features of the refrigerator, such as ice maker 26. Heat from the one or more features such as an ice maker 26 is recirculated back through the refrigerator 10 through outlet 86 and return line 64 or suction line 96. Although FIG. 9 illustrates transferring cooling capacity from the refrigerator 10 to a feature on the door 14 through hinge 82, the present invention further contemplates transferring cooling capacity from the refrigerator 10 to one or more features on the door 14 through any other regions or interfaces between door 14 and cabinet 12 of the refrigerator 10.

Figure 10:
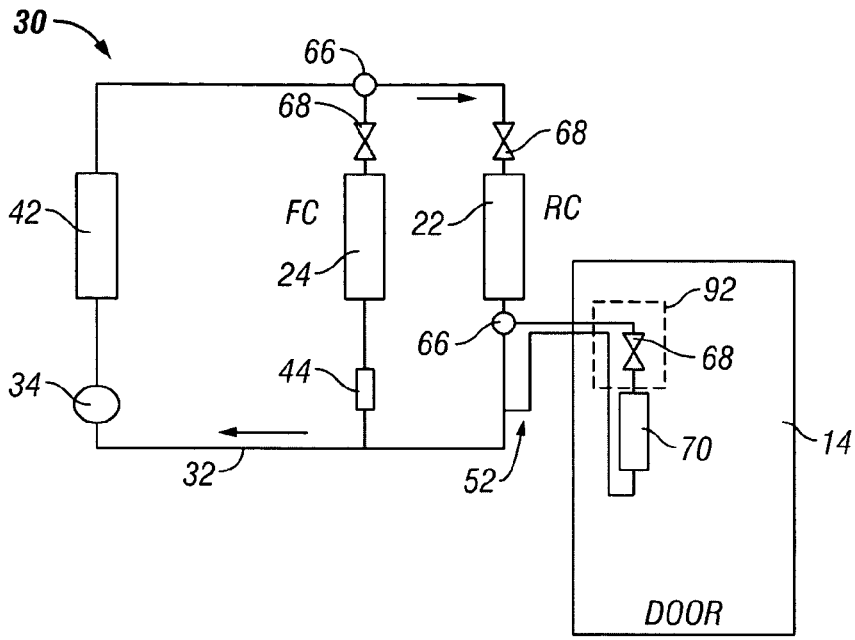
FIG. 10 is a refrigeration schematic having a secondary cooling loop according to an exemplary embodiment of the present invention.
Figure 11:
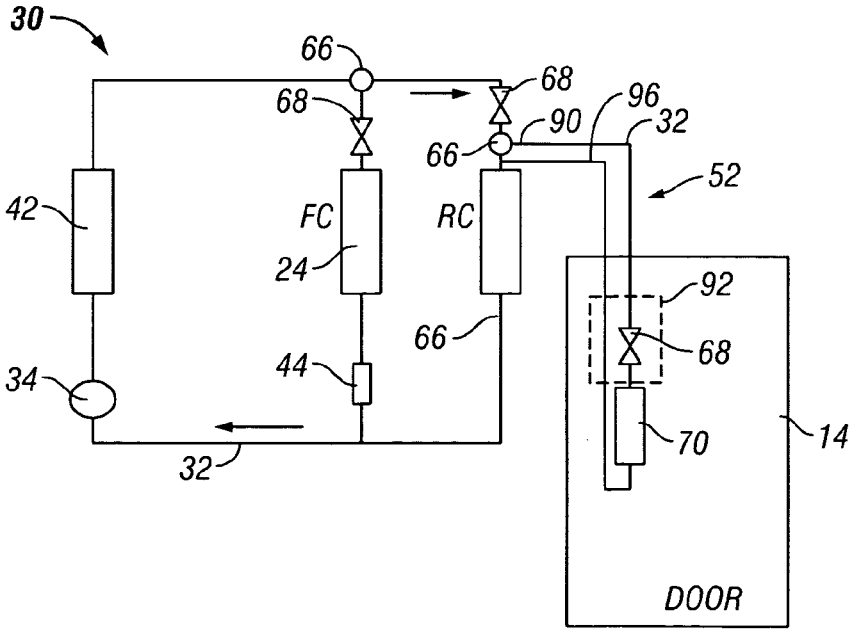
FIG. 11 is another refrigeration schematic having a secondary cooling loop according to an exemplary embodiment of the present invention.

FIGS. 10 and 11 illustrate a couple exemplary embodiments of a first cooling loop 30 adapted to provide cooling to a secondary cooling loop 52 on the door 14. FIGS. 10 and 11 illustrate a refrigeration schematic as described for FIG. 2. A secondary cooling loop 52 is connected to the first cooling loop 30. In FIG. 10, the secondary cooling loop 52 is connected to the first cooling loop 30 after the refrigerator compartment evaporator 22. Secondary cooling loop 52 includes liquid circuit 32 connected to the first cooling loop 30 by way of valve 66. In the preferred form, valve 66 may be a three-way valve adapted to control the flow of cooling liquid in the first cooling loop 30 into the secondary cooling loop 52. Cooling liquid from the first cooling loop 30 travels through the liquid circuit 32, valve 68 into evaporator 70 providing cooling capacity to one or more features on door 14, such as an ice maker or water chiller. If, for example, evaporator 70 is used to provide cooling capacity to an ice maker, valve 66 after the refrigerator compartment evaporator is actuated allowing cooling liquid or refrigerant to flow through hinge 82 toward the ice maker and then back through a suction line within hinge 82 to provide cooling from the first cooling loop 30 to the ice maker 26 coupled to the evaporator 70 of the secondary cooling loop 52. Alternatively, in the ice harvesting process or during defrost, valve 66 may be actuated to close off liquid flow through the secondary cooling loop 52 to prevent heat from the evaporator 70 from being brought back into the refrigerator compartment 20 of the refrigerator 10.

FIG. 11 shows an alternative embodiment of FIG. 10. In FIG. 11, the secondary cooling loop 52 is placed before the refrigerator compartment evaporator 22, thus, valve 66, when actuated, and allows cooling liquid within the first cooling loop 30 to flow through the secondary cooling loop 52. To reach the evaporator 70, cooling liquid from the first cooling loop 30 may be transferred through hinge 82 and into door 14 by way of capillary tube 90. Heat exchanger 92 allows heat from cooling liquid to be dissipated before passing through expansion valve 68 and evaporator 70. Cooling liquid passing through evaporator 70 is brought back into refrigerator 10 through a suction line 96. Thus, cooling capacity may be provided to one or more features on the door 14 through hinge 18 or other suitable interfaces or regions between door 14 and cabinet 12 of refrigerator 10.

The description of the disclosure is merely exemplary in nature and, thus, variations that do not depart from the gist of the disclosure are intended to be within the scope of the disclosure. Such variations are not to be regarded as a departure from the spirit and scope of the disclosure. Changes in the formed proportions of parts, as well as in substitutions of equivalents are contemplated as circumstances may suggest or are rendered expedient without departing from the spirit and scope of the invention as further defined in the following claims.

What is claimed is:

1. A refrigerator having one or more evaporator systems adapted to provide cooling to one or more features of the refrigerator, the refrigerator comprising:

a cabinet;

a cabinet door;

a first cooling loop in the cabinet, the first cooling loop having a first coupler with a first coupling interface, the first cooling loop further including a freezer evaporator and a fresh food evaporator in parallel with each other and wherein the first coupler is in parallel with the freezer evaporator and in series with the fresh food evaporator;

a secondary cooling loop cooled by the first cooling loop, the secondary cooling loop having a second coupler with a second coupling interface and a flow control device to control flow in the secondary cooling loop;

wherein the first coupling interface is in mating engagement with the second coupling interface;

wherein the first coupling interface is in mating engagement with the second coupling interface in both the open and the closed position of the cabinet door; and the secondary cooling loop adapted to cool one or more features in the cabinet or on the door of the refrigerator.

2. The refrigerator of claim 1 wherein the secondary cooling loop includes a thermosyphon or heat pipe to transfer cooling from a freezer and/or evaporator compartment to a heat exchanger associated with an ice maker.

3. The refrigerator of claim 1 wherein cooled liquid in the first cooling loop cools the first coupler to conductively cool the secondary coupler and liquid passing therethrough.

4. The refrigerator of claim 1, wherein the one or more features includes an icemaker, and wherein the icemaker is cooled by the fresh food evaporator.

5. The refrigerator of claim 4, wherein the icemaker is on the cabinet door.

6. The refrigerator of claim 1 wherein the flow control device comprises a pump.

7. The refrigerator of claim 1 wherein the flow control device comprises a valve.

8. A refrigerator having at least two evaporator systems adapted to provide cooling to one or more features of the refrigerator comprising:

a cabinet;

a cabinet door;

a first cooling loop having a freezer compartment evaporator and a refrigerator compartment evaporator in parallel fluid communication with the freezer compartment evaporator, the first cooling loop having a first coupler with a first coupling interface; and a secondary cooling loop, the secondary cooling loop having a second coupler with a second coupling interface, the second coupling interface being in mated engagement with the first coupling interface in both open and closed positions of the cabinet door, whereby the secondary cooling loop is cooled by the refrigerator compartment evaporator of the first cooling loop.

9. The refrigerator of claim 8 wherein the first coupler conductively cools the second coupler to thereby cool liquid in the secondary cooling loop.

10. The refrigerator of claim 8, wherein the first coupling interface is in parallel with the freezer compartment evaporator and in series with the refrigerator compartment evaporator.

11. The refrigerator of claim 8, wherein the one or more features in the cabinet or on the door of the refrigerator includes an icemaker, and wherein the icemaker is cooled by the refrigerator compartment evaporator.

12. The refrigerator of claim 11, wherein the icemaker is on the door of the refrigerator.

13. A refrigerator having one or more evaporator systems adapted to provide cooling to one or more features of the refrigerator, the refrigerator comprising:

a cabinet;

a cabinet door movable between an open and closed position;

a first cooling loop in the cabinet, the first cooling loop having a first coupler with a first coupling interface, the first cooling loop further including a freezer evaporator and a fresh food evaporator in parallel with each other and wherein the first coupler is in parallel with the freezer evaporator and in series with the fresh food evaporator;

a secondary cooling loop cooled by the first cooling loop, the secondary cooling loop having a second coupler with a second coupling interface;

wherein the first coupling interface is in mating engagement with the second coupling interface in both the open and the closed position of the cabinet door; and the secondary cooling loop adapted to cool one or more features in the cabinet or on the door of the refrigerator.

* * * * *